US006102230A

United States Patent [19]

Gould

[11] Patent Number: 6,102,230

[45] **Date of Patent: *Aug. 15, 2000**

[54] ENCLOSURE SYSTEM

[76] Inventor: Schuyler Gould, 10 Kent St., Northfield, Vt. 05663

[ * ] Notice: This patent issued on a continued prosecution application filed under 37 CFR 1.53(d), and is subject to the twenty year patent term provisions of 35 U.S.C. 154(a)(2).

[21] Appl. No.: 08/939,433

[22] Filed: Sep. 26, 1997

[51] Int. Cl.[7] ..... B65D 6/08; B65D 8/00

[52] U.S. Cl. ..... 220/4.04; 52/5; 217/12 A; 220/4.11; 220/23.91; 220/567.2; 220/913

[58] Field of Search ..... 220/23.91, 732, 220/724, 592.24, 668, 592.15, 592.19, 592.23, 592.28, 23.89, 908, 913, 567.2, 4.04, 4.11; 217/4, 49, 12 A, 51, 88; 150/154, 165, 155, 156, 157; 215/12.1; 160/229.1, 130, 231.1, 19, 32, 87, 97; 52/3, 5; 83/63, 198, 83, 248, DIG. 4, DIG. 17, 302.3, 302.4

[56] References Cited

U.S. PATENT DOCUMENTS

| | | | |
|---|---|---|---|
| 115,943 | 6/1871 | Evenden | 220/611 |
| 303,908 | 8/1884 | Ashley | 160/229.1 X |
| 460,998 | 10/1891 | Speer | 217/4 |
| 705,404 | 7/1902 | Hopkins et al. | 220/676 X |
| 897,073 | 8/1908 | Eden | 220/676 X |
| 1,268,201 | 6/1918 | Alexander | 220/592.24 |
| 1,388,804 | 8/1921 | Decy | 217/128 |
| 2,216,638 | 10/1940 | Brockenbrough et al. | 217/49 |
| 2,328,080 | 8/1943 | Hansen | 220/567.2 |
| 2,400,955 | 5/1946 | Samel | 141/302 |
| 2,447,944 | 8/1948 | Johnson et al. | 220/908 X |
| 3,170,587 | 2/1965 | Beeber | 220/908 X |
| 3,205,898 | 9/1965 | Sprague | 414/132 |
| 3,392,220 | 7/1968 | Jennings | 220/567.2 X |
| 4,060,945 | 12/1977 | Wilson | 52/169.5 |
| 4,544,173 | 10/1985 | Kellermyer | 280/47.3 |
| 4,608,798 | 9/1986 | Spiers | 160/130 X |
| 4,905,855 | 3/1990 | Troiano et al. | 220/724 X |
| 4,907,569 | 3/1990 | Lemense | 220/567.3 X |
| 4,955,494 | 9/1990 | Angelone | 220/567.2 X |
| 5,261,555 | 11/1993 | Rogers et al. | 220/694.1 X |
| 5,322,793 | 6/1994 | Yarnell | 435/290.1 |
| 5,490,604 | 2/1996 | Alexander | 220/4.34 X |
| 5,562,229 | 10/1996 | Callahan | 150/154 X |

FOREIGN PATENT DOCUMENTS

| | | | |
|---|---|---|---|
| 0615532 | 1/1961 | Italy | 220/724 |
| 2196682 | 5/1988 | United Kingdom | 220/908 |

OTHER PUBLICATIONS

Cornerstone About Propane, World Wide Web, p. 1 of 1, Sep. 7, 1999.

*Primary Examiner*—Allan N. Shoap
*Assistant Examiner*—Joe Merek
*Attorney, Agent, or Firm*—Downs Rachlin & Martin PLLC

[57] ABSTRACT

An enclosure system for providing a visual barrier with respect to various objects, including a tank of the type used to store fuel, water and other liquid and gaseous materials. The enclosure system includes an enclosure and a lid covering the enclosure. The enclosure is attached to the tank and is made from opaque materials such as wood or dyed plastic. Vent openings are provided to prevent the accumulation of undesirable vapors, e.g., fuel vapors, that may escape from the tank and accumulate between the enclosure and the tank. An attachment mechanism is provided for supporting the enclosure in a predetermined position relative to the tank, e.g., so that the bottom of the enclosure is positioned a few inches above the surface on which the tank rests. An optional second attachment mechanism is provided for ensuring the enclosure remains so positioned relative to the tank.

24 Claims, 5 Drawing Sheets

ENCLOSURE SYSTEM

FIELD OF THE INVENTION

The present invention pertains to enclosures providing a visual barrier for fuel and other tanks, and for other objects which are unsightly or otherwise need to be visually screened.

BACKGROUND OF THE INVENTION

Tanks are often positioned outside residential and commercial structures for storing fuel, water and other liquids and gases. For example, propane used for cooking, heating and other purposes is often stored in a tank positioned next to an exterior wall of a structure.

While necessary to the operation and activity within the structure, such tanks are often relatively unsightly. As a result, vegetation is often planted to provide a visual barrier with respect to the tank. However, vegetation often does not provide a suitable visual barrier, and can impede access to the tank for delivery and maintenance. Sometimes, home and business owners erect a stockade or other fence around the tank to provide a visual barrier. The cost and time associated with installing such a fence, and the restriction to tank access the fence imposes, makes this approach to tank screening less than optimal. In some cases, the appearance of a tank near a structure may be a sufficiently negative proposition that individuals will refuse to install a tank even when needed.

SUMMARY OF THE INVENTION

The present invention is a device for providing visual screening of a tank designed to hold gas such as propane, tanks designed to hold other liquids or gases, and other objects. The device includes at least one member that is configured to surround and restrict visual access to the tank and a fastener attached to the at least one member for attaching the same to the tank. In addition, the at least one member may include at least one opening for venting gases that may escape from the tank.

Another aspect of the present invention is a system including a tank for containing a liquid or gaseous material, at least one member surrounding the tank that substantially visually blocks the tank and a fastener attached to the at least one member for securing the latter to the tank. Here too, the at least one member may include at least one opening for venting gases that may escape from the tank.

DETAILED DESCRIPTION OF THE INVENTION

Figure 1:
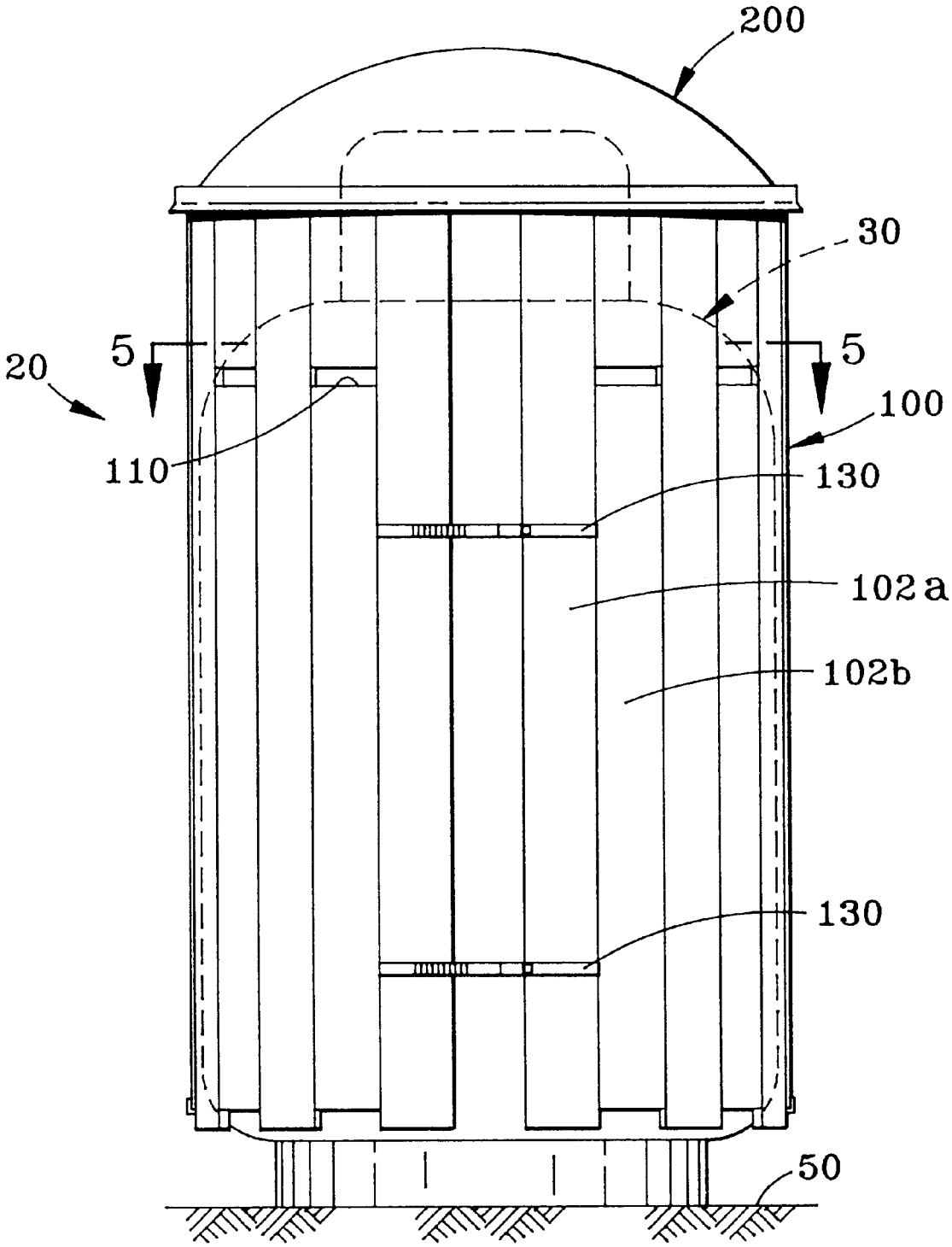
FIG. 1 is a side elevation view of the enclosure system of the present invention and the bottom portion of the tank the enclosure system surrounds, with remaining portions of the tank being shown in phantom view.
Figure 2:
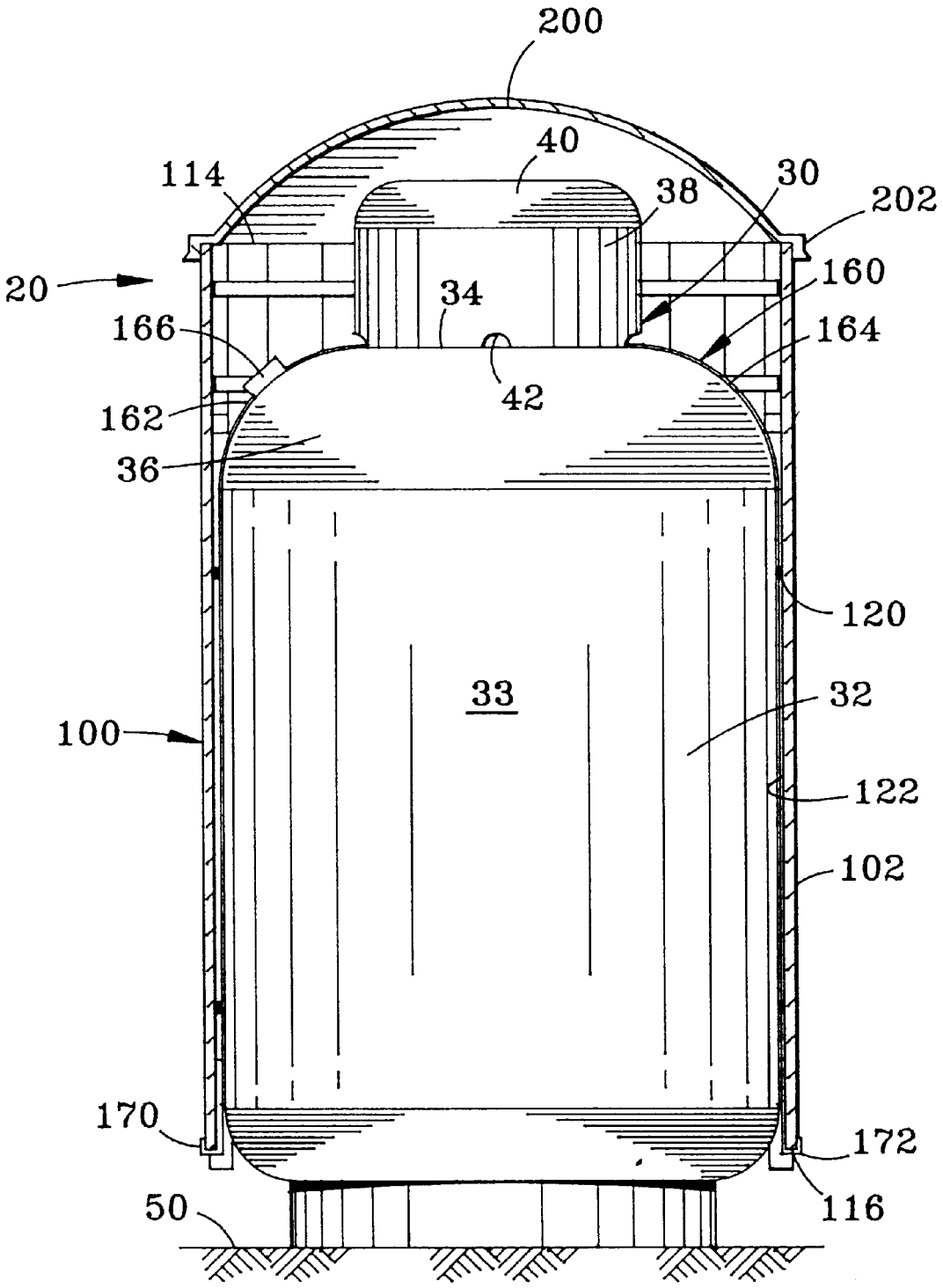
FIG. 2 is a side elevation view of a vertical cross section of the enclosure system of FIG. 1 taken along line 2—2 in FIG. 6, with the tank surrounded by the enclosure being shown in solid view.

Referring to FIGS. 1 and 2, the present invention is an enclosure system 20 for providing a visual barrier relative to a tank or other object.

In a preferred embodiment of the invention, as described below, system 20 is designed to provide a visual barrier relative to a conventional liquid propane gas ("LPG") or propane tank 30 of the type sized to hold about 420 pounds of LPG or propane, and identified by the label DOT 4BW240. As is known, tank 30 includes a central cylindrical section 32 having an outer surface 33, a top portion 34 and a curved shoulder 36 connecting the top and cylindrical sections. Tank 30 also includes hollow cylindrical housing 38 attached to and extending upwardly from top portion 34, and cap 40 hinged to the housing. By opening cap 40, access may be obtained to the fill and pressure relief valves (not shown), gauges (not shown) and other components of tank 30 enclosed by housing 38 and cap 40. Typically, four openings 42 are provided in housing 38 immediately above the intersection of the housing with top portion 34, each spaced 90° from adjacent openings. Tank 30 is positioned on surface 50.

Enclosure system 20 may also be used to enclose other tanks, and more generally almost any elongate structure of cylindrical or other configuration. For example, enclosure system 20 may be used to enclose a tank for storing water, a well head or a concrete pylon.

Enclosure system 20 comprises enclosure 100 and lid 200. Enclosure 100 is designed to surround tank 30 and lid 200 is positioned on top of the enclosure. While the use of lid 200 is preferred, it is not an essential element of enclosure system 20.

In a preferred embodiment, enclosure 100 has a plurality of staves 102 which are preferably made from an opaque or translucent material that is weather resistant, has sufficient mechanical strength, and has a pleasing visual appearance. Suitable materials for staves 102 include rot-resistant woods (as depicted by stave 102' in FIG. 5) such as cedar and redwood, plastics (as depicted by stave 102" in FIG. 5) such as polyethylene, polyurethane and ABS, and wood-polymer composites of the type sold under the trademark TREX by Trex Co. LLC of Winchester, Va. Staves 102 are positioned relative to one another so that little, if any, gap exists between adjacent staves. In one embodiment of the invention staves 102 are white cedar, are about 4 feet long, and have a nominal cross section of 1 inch by 4 inch.

Figure 5:
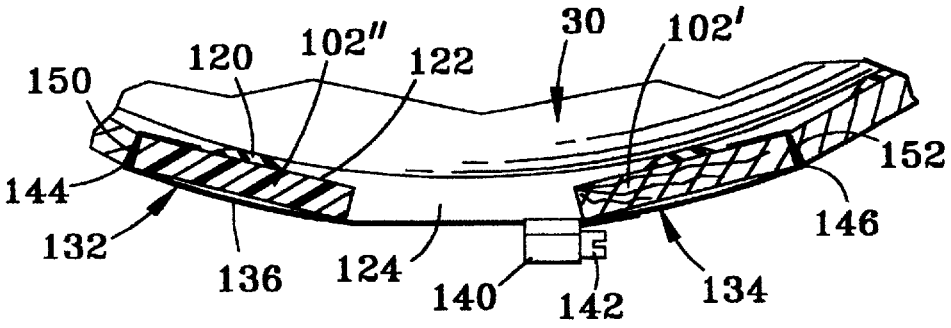
FIG. 5 is a partial cross section of the enclosure taken at line 5—5 in FIG. 1, illustrating details of the clamp used to secure together confronting edges of the enclosure, with adjacent portions of the tank being shown in a partial top view.

Referring to FIGS. 1, 2 and 5, the number of staves 102 used is selected so that the circumference of enclosure 100 is preferably slightly less, i.e., about the width of one stave, than the circumference of tank 300. As a result of sizing enclosure 100 in this manner, a vertical opening 124 (see FIG. 5) exists between confronting staves 102' and 102" for the purpose of accommodating slight variations in the nominally standard circumference of tank 30.

Alternatively, enclosure 100 may be made from a single sheet of material that is opaque or translucent, e.g., polypropylene, polyurethane, polyethylene or ABS. When made from such material, enclosure 100 may be made from a flexible material that can be wrapped around tank 30, or may be made molded in a cylindrical configuration corresponding to that of the tank. In the latter case, enclosure 100 is positioned over tank 30, rather than being wrapped around the tank. Several pieces of material may also be used to make enclosure 100. The specific size and configuration of enclosure 100 is dictated by the size and configuration of the object to be enclosed.

When enclosure 100 is used to enclose a tank 30 containing LPG or propane, a number of vents 110 are provided extending through staves 102. Vents 110 are provided to prevent the accumulation of gases that may escape from tank 30 in the region enclosed by system 20. The size, number and placement of vents 110 are selected so as to prevent such accumulation of gases in such region and to comply with any relevant LPG, propane or other industry standards. For example, the International Approval Services is adopting a standard for tank enclosures identified by "IAS U.S. 3-96 LP Tank Enclosure," that specifies the area of vents that must be provided in tank enclosures.

In a preferred embodiment of the invention, vents 110 are provided in staves 102*a*, which are separated from one another by ventless staves 102*b*. Thus, in the preferred embodiment every other stave 102 includes a vent 110. It is believed to be advantageous to position vents 110 so as to be substantially vertically aligned just above the bottom portion of shoulder 36 of tank 30 when enclosure 100 is positioned relative to the tank in the manner illustrated in FIGS. 1 and 2, as described in more detail below. However, other placement of vents 110 will also provide satisfactory results. In this regard, vents 110 need not be horizontally aligned in the manner shown in FIG. 1. In any event, if tank 30 contains explosive gases, it is recommended that vents 110 be positioned so as to be vertically aligned with that portion of tank 30 between the bottom of shoulder 36 and the top of housing 38. If enclosure 100 is used in connection with tanks not containing explosive gases, vents 110 may be placed at almost any location on enclosure 100.

Also in the preferred embodiment, vents 110 are sized so that the total area of (a) vents 110 and (b) the open circumferential space between the bottom of enclosure 100 and surface 50, is equal to or greater than about 1 square inch for each pound of gas that can be stored in tank 30. Preferably, at least 50% of this total area is provided below the bottom of enclosure 100. For example, if tank 30 can hold 420 pounds of LPG or propane, the total area of vents 110 and the open circumferential space between the bottom of enclosure 100 and surface 50 should be at least 420 square inches with at least 210 square inches of this area provided below the bottom of enclosure 100. Thus, the total area of vents 110 is preferably about 0.1 to 0.5 square inches times the magnitude of the weight in pounds of propane or liquid natural gas that can be accommodated in tank 30 when full. For example, if tank 100 can hold 420 pounds of propane, the total area of vents 110 is preferably 42 to 210 square inches (0.1–0.5×420). More information concerning the placement and size of vents 110 is provided below, following the description of installation of the invention.

Figure 4:
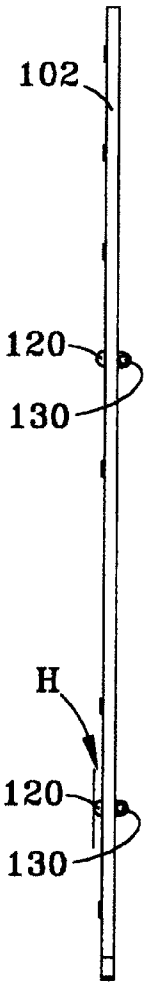
FIG. 4 is a side elevation view of one stave of the enclosure illustrating spacers used to space the enclosure from the tank.
Figure 3:
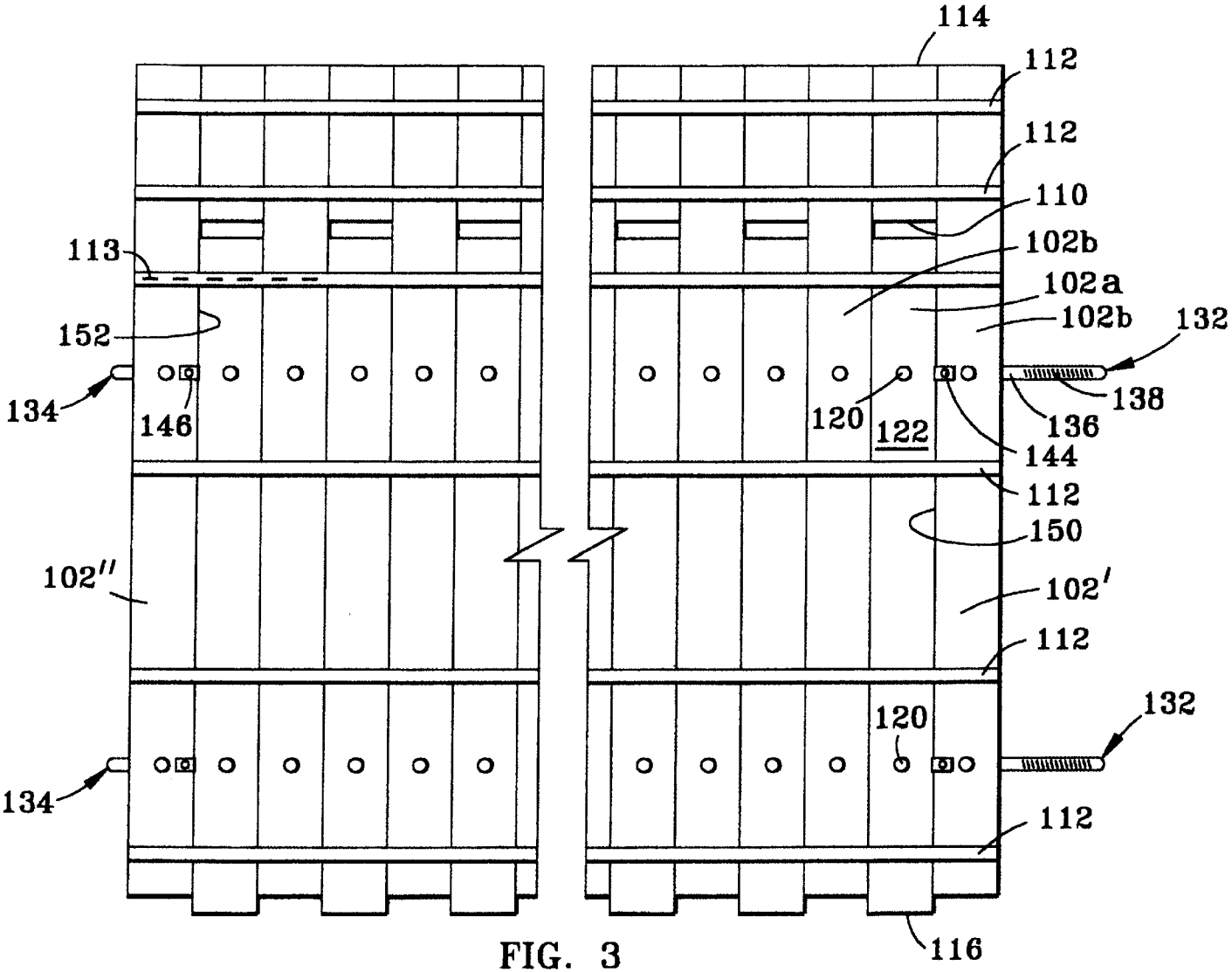
FIG. 3 is top view of the inner surface of the enclosure, spread out flat on a surface, with an intermediate portion of the enclosure being removed to facilitate illustration.

Turning now to FIGS. 1, 3 and 4, in the preferred embodiment adjacent staves 102 touch one another or are separated by a minimal amount, e.g., 1/32 to ½ inch. Staves 102 may be secured together using a variety of techniques so that enclosure 100 has a cylindrical configuration corresponding to that of tank 30 or so that, as illustrated in FIG. 3, the enclosure is substantially planar and maybe wrapped around the tank. These techniques include securing staves 102 together with rigid or flexible fasteners, bands or brackets, gluing the staves together, or keying the staves together with dovetail joints or other interlocking structure.

Preferably, as illustrated in FIG. 3, staves 102 are secured together with flexible bands 112 extending roughly perpendicular to the long dimension of the staves. Bands 112 are preferably made from rot and stretch-resistant materials such as nylon, polypropylene or polyethylene. Bands 112 are attached to staves 102 using fasteners such as nails, screws or staples, the latter being preferred at the rate of two staples 113 (only several of which are shown in FIG. 3 for clarity of illustration) per stave. The number of bands 112 used depends on the width of the bands, the height of enclosure 100 and the desired structural integrity of the enclosure. In the embodiment of the invention illustrated in FIG. 3, six bands 112 are used, each about ¾ inch wide. Bands 112 should be fairly evenly distributed over the length of enclosure 100, although it is preferred that a band be positioned about 4–6 inches from top end 114 and bottom end 116 of the enclosure, and two bands be positioned in the region between vents 110 and top end 114 of enclosure 100.

Referring next to FIGS. 1–5, under certain atmospheric conditions, moisture may condense on the outer surface of tank 30. This moisture, if held against tank 30 by enclosure 100, may cause the tank to corrode and could degrade the enclosure. To prevent this problem, a plurality of spacers 120 (FIGS. 2–5) are preferably attached to inner surface 122 of staves 102. Spacers 120 hold inner surface 122 away from outer surface 33 of cylindrical section 32 of tank 30 so as to create a space between surfaces 122 and 33. The height H (FIG. 4) of spacers 120 may range from 1/16 to 2 inches, preferably ¼ to ¾ inch. However, if spacers 120 are made from a compressible material, then height H will need to be somewhat greater than these dimensions so that when enclosure 100 is wrapped around tank 30 as illustrated in FIG. 1 and described below, spacers 120 have a height in the 1/16 to 2 inch range. Plastic, rubber and other non-absorbent, moisture-resistant materials may be used for spacers 120. Spacers 120 may be made from strips of material extending substantially perpendicular to the long dimension of staves 102, from "buttons" of material attached to inner surface 122 of staves 120 so as to collectively extend in such perpendicular direction, or from material of other configuration.

Referring now to FIGS. 1, 3 and 5, when enclosure 100 is designed as a flexible structure that can be wrapped around tank 30, as illustrated in these figures, at least one clamp 130 is provided for securing together outermost staves 102' and 102" (see FIGS. 3 and 5) in confronting relation. Clamp 130 may have a variety of designs, although it is preferred the clamp be capable of pulling together and holding together staves 102' and 102" in the confronting relation illustrated in FIGS. 1, 5, 6 and 8. In a preferred embodiment, bracket 130 is a modified worm gear clamp having rack portion 132 and a pinion portion 134. Rack portion 132 has a flat portion 136 with a plurality of slots 138 formed therein. Pinion portion 134 includes a housing 140 having a pinion gear (not shown) to which screw head 142 is attached. The teeth (not shown) of pinion gear are designed to engage slots 138 in flat portion 136 so that when screw head 142 is turned, flat portion 136 is drawn into and through housing 140.

Rack portion 132 includes a U-shaped portion 144 (see FIG. 5) and rack portion 134 includes a U-shaped portion 146 (see FIG. 5). U-shaped portions 144 and 146 are configured to wrap around, respectively, edge 150 (see FIG. 5) of stave 102' and edge 152 (see FIG. 5) of stave 102". Preferably, but not necessarily, U-shaped portions 144 and 146 are secured to staves 102' and 102" (see FIG. 3), respectively. In a preferred embodiment, two clamps 130 are provided, one positioned near the middle of enclosure 100, as measured between upper end 114 and lower end 116, and the other positioned about 6–12 inches above bottom end 116. In this embodiment, spacers 120 are substantially vertically aligned with clamps 130.

Enclosure system 20 may optionally include a support system for supporting bottom end 116 of enclosure 100 at a predetermined distance, e.g., 4–6 inches above surface 50, as illustrated in FIG. 2 and described in more detail below. This support system may consist of one of a number of different devices. For example, the system may include (a) one or more blocks (not shown) positioned on surface 50, with bottom edge 116 of enclosure 100 resting on such blocks, (b) magnets (not shown) secured to staves 102 so as to support enclosure 100 by magnetic engagement with tank 30 when the latter is made from steel, and (c) a hook, strap and buckle support system, the latter being preferred.

Figure 6:
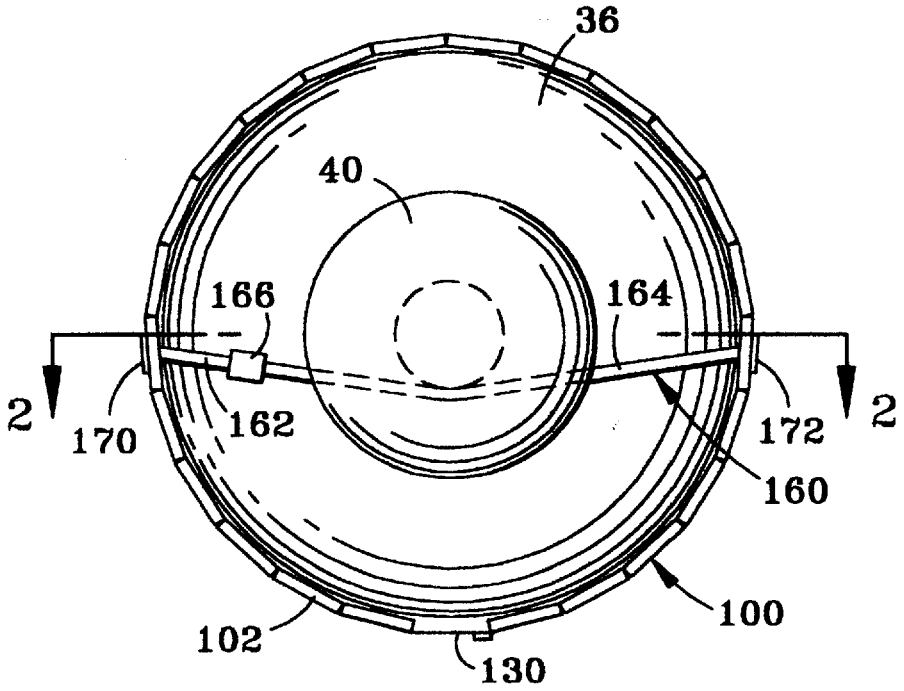
FIG. 6 is top view of the enclosure system of FIG. 1, with the lid removed to reveal the tank.
Figure 7:
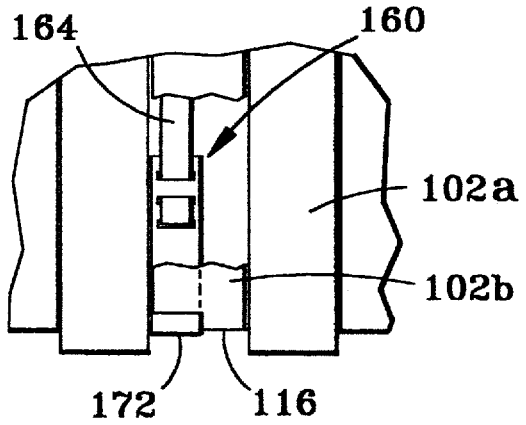
FIG. 7 is a partial side elevation view of the tank enclosure illustrating details of the strap and hook used to secure the enclosure to the tank.

Referring now to FIGS. 2, 6 and 7, support system 160 is provided for securing enclosure 100 in selected vertical relationship with tank 30, such as that illustrated in FIG. 2. Support system 160 includes straps 162 and 164 which are secured together by buckle 166. Preferably, buckle 166 both permits straps 162 and 164 to be drawn toward one another and secures the straps relative to one another in selected relation. Alternatively, a single strap (not shown) having a length equal to that of straps 162 and 164 may be used in place of the two straps. In such case, buckle 166 is not required. Also, straps 162 and 164 may be individually secured to tank housing 38 with a hook and buckle or similar cinching mechanism. When enclosure system 20 will be used in an environment where a substantial load, i.e., from snow, will be applied to lid 200, it may be desirable to use two support systems 160, positioned in mutually perpendicular relation.

Support system 160 also includes hooks 170 and 172 which are secured, respectively, to the ends of straps 162 and 164. Hooks 170 and 172 have a U-shaped configuration sized so as to receive portions of staves 102*b* (see FIG. 7) adjacent bottom edge 116. As described in more detail below, straps 162 and 164 are sized so that when secured together by buckle 166 they extend from a first location on bottom edge 116, up over the top of tank 30 and down to a second location on bottom edge 116 that is positioned approximately opposite, i.e., 180° away from, the first location.

Figure 8:
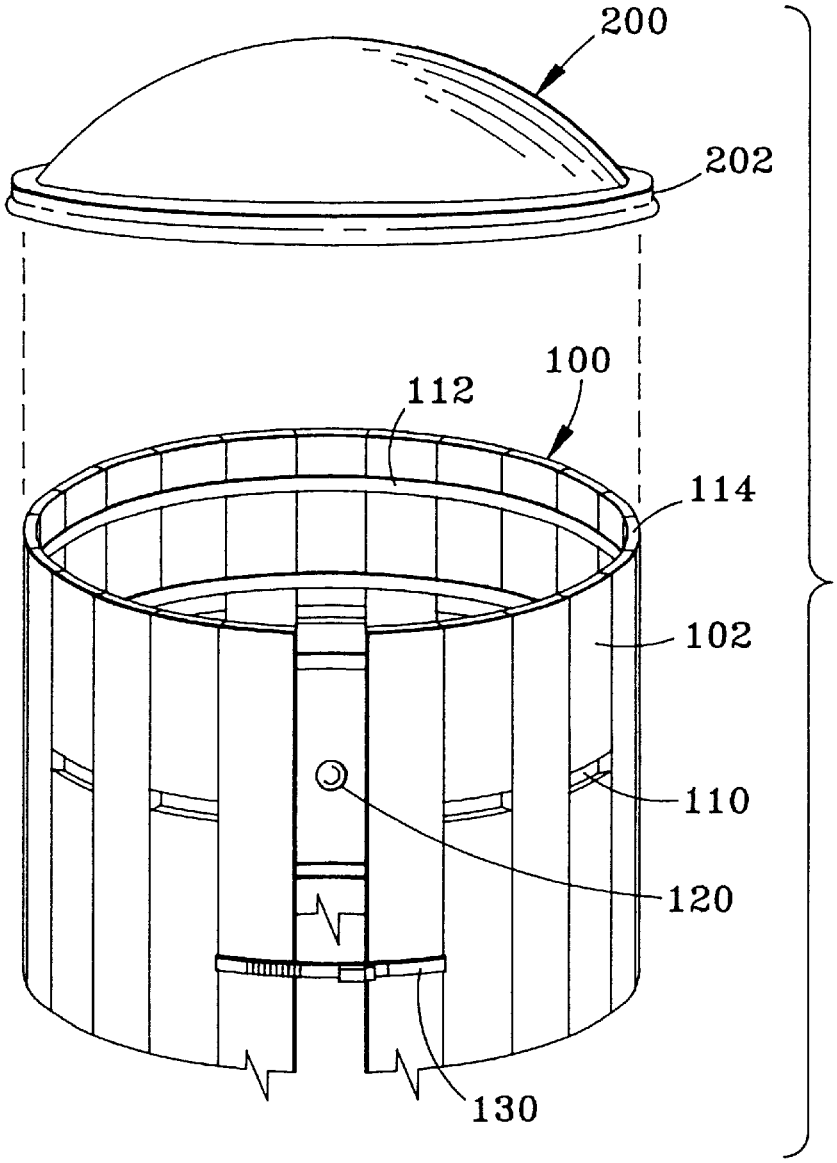
FIG. 8 is an exploded perspective view of the enclosure and lid.

Turning now to FIGS. 1, 2 and 8, enclosure system 20 preferably, but not necessarily, includes lid 200. The latter is sized to sit on top of enclosure 100, engaging top surface 114. If desired, lid 200 may include a flexible flange 202 at the periphery of the lid for compressively engaging portions of staves 102 adjacent top edge 114 of enclosure 100. Lid 200 may be made from a variety of materials including wood, metal, plastic and composites.

Figure 9:
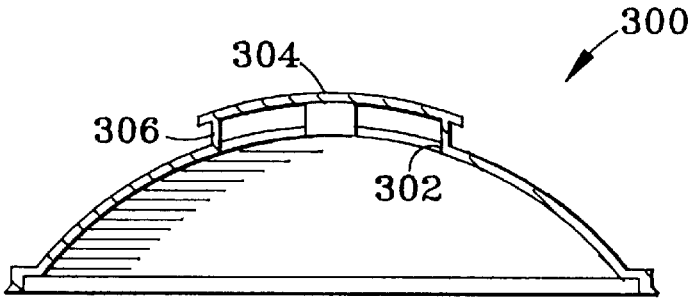
FIG. 9 is a cross-sectional side elevation view of another embodiment of the lid.

Referring to FIG. 9, in some circumstances, e.g., when enclosure system 20 is used in a hot climate, it may be desirable to provide ventilation in the lid of the system. To this end, an alternative embodiment of the lid, identified by reference numeral 300 in FIG. 9, is provided. Lid 300 is identical to lid 200, except that it has a central opening 302 which is covered by cap 304 supported above opening 302 by legs 306. Preferably, legs 306 are sized so that the peripheral edge of cap 304 is spaced about 1" above adjacent portions of lid 300. Also, cap 304 is preferably sized to overhang opening 302 by about 1".

Installation of the preferred embodiment of enclosure system 20, illustrated in FIGS. 1–9, proceeds as follows. This description assumes enclosure 100 is assembled to the degree illustrated in FIG. 3, and is in the substantially planar position illustrated in FIG. 3. Enclosure 100 is moved adjacent tank 30 so that staves 102 are in a substantially vertical position and top end 114 is positioned on top. Next, enclosure 100 is wrapped around tank 30. The flexible nature of bands 112 permits the discrete staves 102 to move relative to one another sufficiently to permit such wrapping. In some cases, it may be necessary to remove the top portion of one or more staves 102a to accommodate a gas supply line (not shown) leading away from tank 30.

Flat portion 136 of rack portion 132 of clamp 130 is then inserted into housing 140 of pinion portion 134 of clamp 130 so that the teeth (not shown) in the housing engage slots 138, and screw head 142 is turned so as to draw the flat portion into the housing. As this turning action continues, staves 102' and 102" are drawn toward one another, causing enclosure 100 to compressively engage tank 30. Spacers 120 provide the point of contact between enclosure 100 and tank 30. Before clamps 130 are tightened sufficiently to prevent enclosure 100 from moving vertically relative to tank 30, the enclosure is vertically positioned as desired, preferably so that bottom end 116 of the enclosure is positioned about 4-6 inches above surface 50. In this position, vents 110 are positioned in substantial vertical alignment just above the bottom of shoulder 36 of tank 30. Finally, lid 200 or 300 is positioned on top end 114 of enclosure 100.

Under some circumstances the compressive engagement of enclosure 100 with tank 30 created by clamps 130 is sufficient to retain the enclosure in the above-described position relative to the tank. However, to ensure enclosure 100 remains in this position, one of the above-described support systems, such as support system 160, may be employed. Support system 160 is partially installed before enclosure 100 is secured to tank 30. In this regard, what will become the buckled end of strap 164 is inserted through diametrically opposed openings 42 at the base of housing 38, avoiding all valves and gauges as necessary (see FIG. 6), and the remainder of strap 164, with hook 172 secured to its lower end, is draped over the outer surface 33 of tank 30 and adjusted until hook 172 is just resting on surface 50. Strap 164 is then temporarily secured in this position to the outer surface 33 of tank 30 using tape or other suitable materials. Next, strap 162, with hook 170 secured to its lower end, is draped over outer surface 33 of tank 30 in substantially diametrically opposed relation to strap 164 and is adjusted until hook 170 is just resting on surface 50. Strap 162 is also temporarily secured in this position with tape or other suitable materials.

Following installation of enclosure 100 on tank 30 as described above, hooks 170 and 172 are positioned to engage bottom end 116 of the enclosure, preferably on diametrically opposed ventless staves 102*b* and to one side of each of the staves (see FIG. 7) to allow attached straps 162 and 164 to avoid spacers 120 attached to said staves. Straps 162 and 164 are then adjusted relative to one another so that hooks 170 and 172 pull upwardly against bottom edge 116 with moderate force. This adjustment is achieved via buckle 166 or similar cinching mechanism. Tape or other materials for temporarily securing straps 162 and 164 to tank 30 may be removed if desired. Following this procedure, enclosure 100 is then installed around tank 30 in the manner described above.

As noted above, when lid 200 or 300 will be subjected to a heavy load, two support systems 160 may be needed. Each of the support systems 160 is installed in the manner described above, with the systems being positioned in mutually perpendicular relation.

The total area of vents 110 and the circumferential opening between bottom end 116 of enclosure 100 and surface 50, described above, i.e., about 1 square inch for each pound of gas stored in tank 30, is selected based on the assumption bottom end 116 of enclosure 100 will be positioned about 4–6 inches above surface 50. With such positioning, about 0.1 to 0.5 of the total desired vent area for enclosure 100 is provided via vents 110. As illustrated in FIGS. 1–3 and 8, only about 0.1 of the total desired vent area is provided by vents 110. The circumferential opening below enclosure 100 is designed to prevent gases that escape from tank 30 and enclosure 100 from accumulating at the base of the enclosure.

When enclosure system 20 is used to enclose tanks or other objects that do not potentially emit gases requiring ventilation, vents 110 are not required and it is not necessary from a ventilation standpoint that enclosure 100 be positioned above surface 50. However, if the tank or other object is subject to rot or corrosion as a result of the presence of moisture within enclosure system 20, it may still be desirable to use vents 110 and/or position enclosure 100 above surface 50.

An important advantage of enclosure system 20 when installed relative to tank 30 in the manner described above is that the enclosure system substantially visually blocks the tank. This permits a tank 30 to be installed in certain environments where it could not otherwise be used due to the relatively unattractive nature of such tanks. Even where aesthetic concerns would not block installation of tank 30, enclosure system 20 provides a more visually satisfying appearance for the tank. The small portions of tank 30 that may be visible through enclosure 100, e.g., via vents 110 or opening 124, do not detract to any meaningful extent from the overall aesthetic benefit provided by the present invention.

Since certain changes may be made in the enclosure system described above without departing from the present invention, it is intended that all matter contained in the above description or shown in the accompanying drawings be interpreted in an illustrative and not in a limiting sense.

What is claimed is:

1. A device for providing visual screening of a tank containing liquid propane or liquid natural gas having a weight, the tank designed to rest on a surface and having a top end with an upwardly facing surface, a bottom end, a sidewall connecting the top end and bottom end, the sidewall having an outer surface, the tank also including a shoulder where the top end meets the sidewall, the device comprising:

a. a structure having an inner surface, a first end, a second end, a first at least one opening extending through said structure, said first at least one opening having a first area equal to 0.1 to 0.5 square inches times the magnitude of the weight in pounds of liquid propane or liquid natural gas that can be accommodated in the tank when full, wherein said first at least one opening is located so that when said structure is positioned to surround the tank, said second end is positioned about 4–6 inches above the surface on which the tank rests, said first at least one opening is positioned entirely beteen a horizontal plane intersecting the shoulder of the tank and said first end, further wherein said structure is configured to surround and substantially visually block the tank; and b. an attachment strap connected to said structure and engaging the upwardly facing surface of the tank, when said structure surrounds the tank, so as to cause said structure to be supported by the tank in fixed, spaced relation to the surface on which the tank rests.

2. A device according to claim 1, wherein said structure is opaque.

3. A device according to claim 1, wherein said structure is made from wood.

4. A device according to claim 1, wherein said structure is made from plastic.

5. A device according to claim 1, wherein said structure is made from a composite material.

6. A device according to claim 1, wherein said structure comprises a plurality of members, said device further including a coupler for securing said plurality of members together.

7. A device according to claim 6, wherein said plurality of members are elongate staves.

8. A device according to claim 6, wherein said coupler includes one or more flexible bands and means for securing said one or more flexible bands to said plurality of members.

9. A device according to claim 8, wherein said means for securing includes a plurality of staples.

10. A device according to claim 1, further including at least one clamp attached to said structure for drawing said structure radially inwardly toward the tank.

11. A device according to claim 1, wherein said first at least one opening includes a plurality of openings.

12. A device according to claim 1 wherein said first area is equal to about 0.1 square inches times the magnitude of the weight in pounds of liquid propane or liquid natural gas that can be accommodated in the tank when full.

13. A device according to claim 1, wherein said structure includes a plurality of adjacent elongate staves, and further wherein said first at least one opening includes a plurality of openings formed in first ones of said elongate staves.

14. A device according to claim 1, further comprising a lid sized to engage and cover said first end of said structure when positioned to surround the tank.

15. A device according to claim 14, wherein said lid has a ventilation opening.

16. A device according to claim 1, further including a spacer assembly positionable between and engageable with said inner surface and the outer surface of the sidewall of the tank, when said structure is positioned to surround the tank, said spacer assembly having a thickness selected so as to seperate said inner surface of said structure from the outer surface of the sidewall of the tank by 1/16 to 2 inches such that at least one passage is provided between said inner surface and the outer surface of the sidewall of the tank extending from said first at least one opening to said second end.

17. A device according to claim 1, wherein said attachment strap has first and second ends, said device further including first and second hooks engaging said structure adjacent said second end, wherein said first and second hooks are connected, respectively to said first and second ends of said attachment strap.

18. A system comprising:

a. a tank containing liquid propane or liquid natural gas having a weight, said tank designed to rest on a surface and having a top end, a bottom end, a sidewall connecting said top end and said bottom end, said sidewall having an outer surface, said tank also including a shoulder where said top end meets said sidewall;

b. a structure that surrounds and substantially visually blocks said tank, said structure having an inner surface, a first end, a second end, a first at least one opening extending through said structure and positioned entirely between a horizontal plane intersecting said shoulder of said tank and said first end, said first at least one opening having a first area equal to 0.1 to 0.5 square inches time the magnitude of the weight in pounds of liquid propane or liquid natural gas that can be accommodated in the tank when full; and c. an attachment system connected to said structure for causing said structure to engage the tank so that said structure is supported by the tank in fixed, spaced relation to the surface on which the tank rests.

19. A system according to claim 18, wherein said structure includes a plurality of adjacent elongate members and said first at least one opening comprises a plurality of openings in first ones of said plurality of elongate members.

20. A system according to claim 18, further including a spacer assembly positioned between and engaged with said inner surface and said outer surface of said sidewall of said tank, said spacer assembly having a thickness selected so as to separate said inner surface of said structure from said outer surface of said sidewall of said tank by 1/16 to 2 inches such that at least one passage is provided between said inner surface and said outer surface of said sidewall of said tank extending from said first at least one to said second end.

21. A device according to claim 1, wherein said first at least one opening is positioned on said structure so that when said structure surrounds the sidewall of the tank, said first at least one opening is adjacent the shoulder of the tank.

22. A device according to claim 1, wherein said attachment strap is designed to support said structure relative to the tank so that a circumferential space is created between said second end and the surface on which the tank rests, said circumferential space having an area equal to at least 0.5 square inches for each pound of liquid propane or liquid natural gas the tank can accommodate when full.

23. A device according to claim 18, further including at least one clamp attached to said structure for drawing said structure radially inwardly toward said tank.

24. A method of substantially visually blocking access to a tank that rests on a surface and is designed to contain liquid propane or liquid natural gas, the method comprising the steps of:

a. providing a device as recited in claim 1;

b. positioning said device to surround the tank so that said second end is located above the surface on which the tank rests such that a circumferential opening having a second area is provided between said second end and the surface; and c. wherein said positioning step b is performed so that the total area of said first area and said second area equals about one square inch for each pound of liquid propane or liquid natural gas that can be accommodated in the tank when full.

* * * * *

UNITED STATES PATENT AND TRADEMARK OFFICE

CERTIFICATE OF CORRECTION

PATENT NO. : 6,102,230
DATED : August 15, 2000
INVENTOR(S) : Schuyler Gould

It is certified that error appears in the above-identified patent and that said Letters Patent is hereby corrected as shown below:

Column 7,
Line 67, delete "," after the word "tank" and insert therefor -- such that --;

Column 8,
Line 3, delete "beteen" and substitute therefor -- between --.

Signed and Sealed this

Twenty-fifth Day of December, 2001

*Attest:*

*Attesting Officer*

JAMES E. ROGAN
*Director of the United States Patent and Trademark Office*